United States Patent [19]

Smith

[11] 3,973,369

[45] Aug. 10, 1976

[54] ROOFING SHINGLE

[75] Inventor: Robert L. Smith, Newkirk, Okla.

[73] Assignee: Billy G. Powers, Arkansas City, Kans. ; a part interest

[22] Filed: Apr. 14, 1975

[21] Appl. No.: 568,049

[52] U.S. Cl. ..... 52/526; 52/555

[51] Int. Cl.[2] ..... E04D 1/20; E04D 1/26; E04D 3/62

[58] Field of Search ..... 52/526, 555

[56] References Cited

UNITED STATES PATENTS

| | | | |
|---|---|---|---|
| 1,587,017 | 6/1926 | MacInnes | 52/526 |
| 1,595,080 | 8/1926 | Fischer | 52/526 |
| 1,795,277 | 3/1931 | Fischer | 52/526 |
| 2,171,010 | 8/1939 | Schuetz et al. | 52/555 |
| 2,801,599 | 8/1957 | Bordeaux | 52/526 |

*Primary Examiner*—Alfred C. Perham
*Attorney, Agent, or Firm*—John A. Hamilton

[57] ABSTRACT

A roofing shingle having apertures formed therein in upwardly spaced relation from the lower or free edges of the tab or tabs thereof adapted to receive the lower corners of the tabs of the shingles in the next higher course of shingles, when said shingles are applied in courses, in order to anchor said tabs to reduce any likelihood of damage commonly resulting when free, unanchored shingle tabs are peeled away from the roof by high winds. The apertures may permit the passage of some rain or other moisture therethrough, but any such moisture is trapped and safely disposed of by a special backing applied to the shingle, the backing also serving as a "dry-ply" between the shingles and the sheathing boards of the roof.

5 Claims, 8 Drawing Figures

ROOFING SHINGLE

This invention relates to new and useful improvements in roofing shingles, and has as its principal object the provision of shingles so formed that when they are applied to a roof in horizontal courses in the usual manner, the tabs thereof, being those portions thereof exposed to the weather and usually freely overlying but not secured in any way to the next lower course of shingles, are actually and securely affixed to the next lower course of shingles. In this manner, the all too common "peeling" of shingles from a roof when a high wind curls unsecured shingle tabs upwardly is prevented or greatly reduced. Generally, this object is accomplished by forming small apertures in each shingle into which the lower edges of the tabs of the shingles of the next higher course of shingles are inserted as the shingles are applied.

If the apertures are positioned to engage corners of the tabs of the next higher course of shingles, and the shingle tabs are of uniform length, then the apertures of one shingle for receiving adjacent corners of two tabs of the next higher shingle would be so closely spaced as to seriously weaken the shingle, leaving only a thin strip which could easily be torn out. To prevent this, alternate tabs are made of different lengths, so that said apertures may be widely spaced apart and the shingle hence not appreciably weakened.

The apertures of course permit some small amount of rain and other moisture to pass therethrough, but any such moisture is trapped and conveyed harmlessly to the top surface of the next lower course of shingles by a special backing applied to the shingle.

Other objects are simplicity and economy of construction, ease and convenience of use, and efficiency and dependability of operation.

Figure 1:
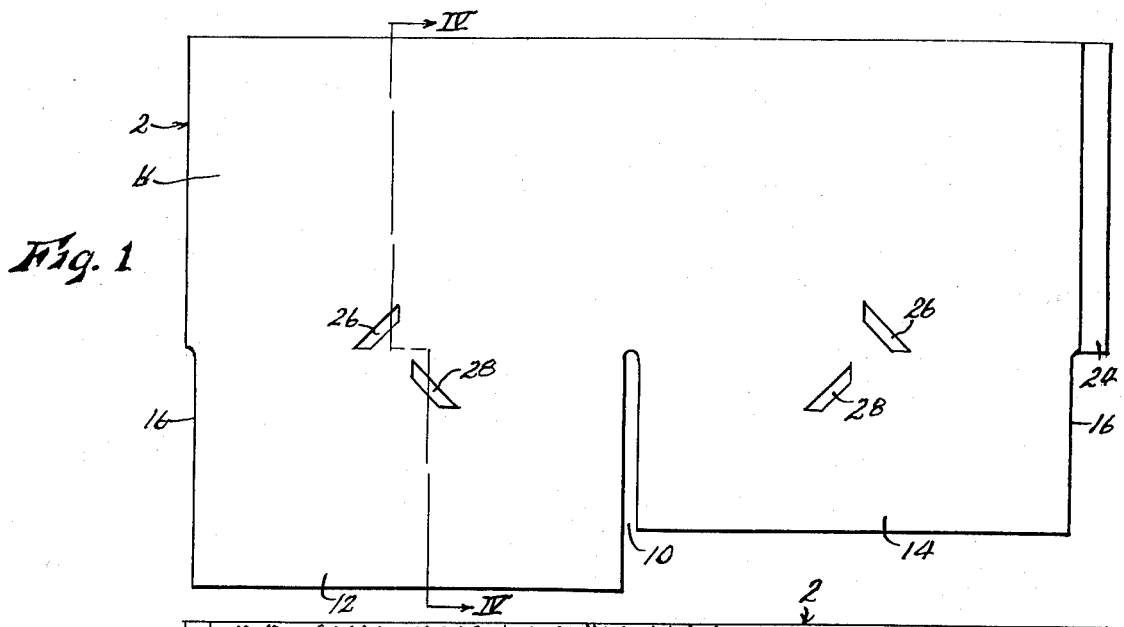
Figure 2:
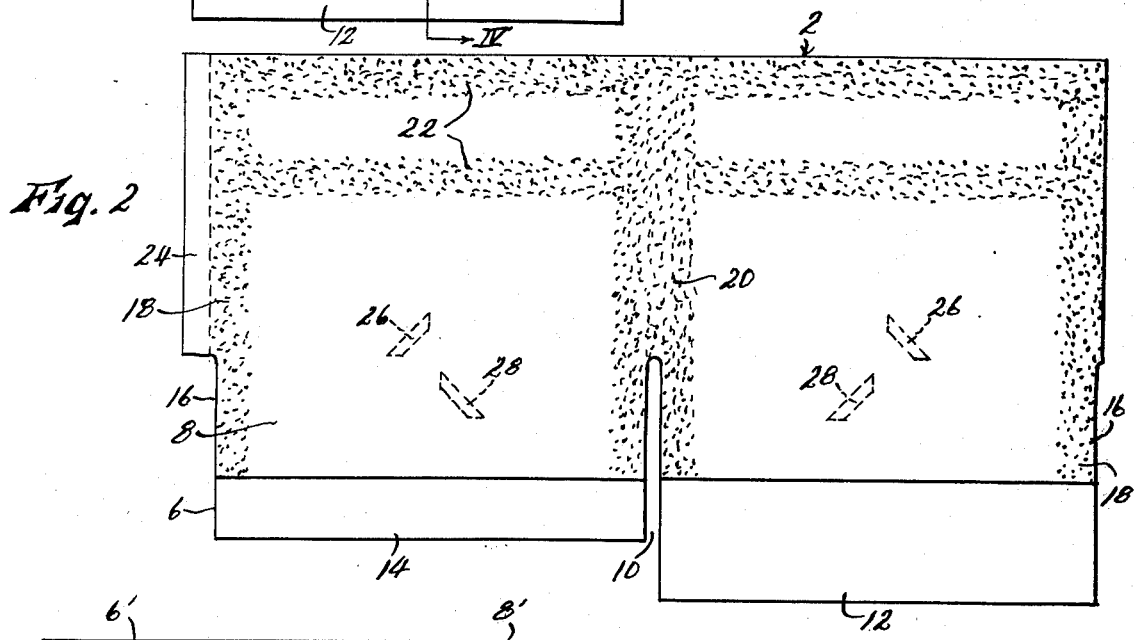
Figure 7:
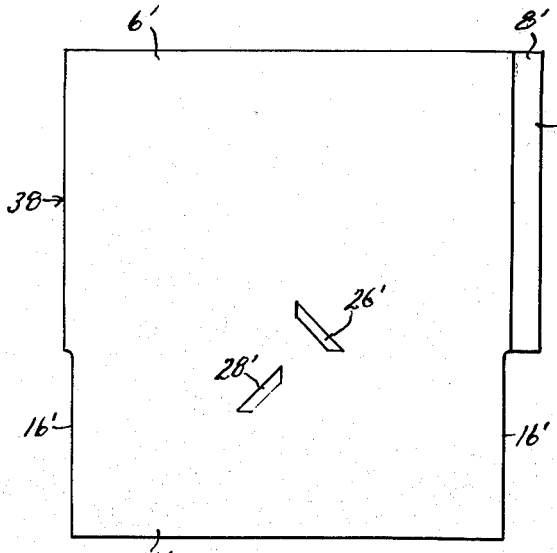
Figure 8:
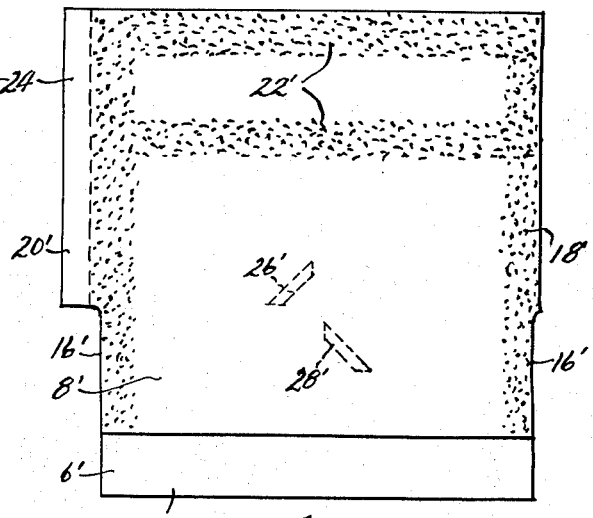
Figure 3:
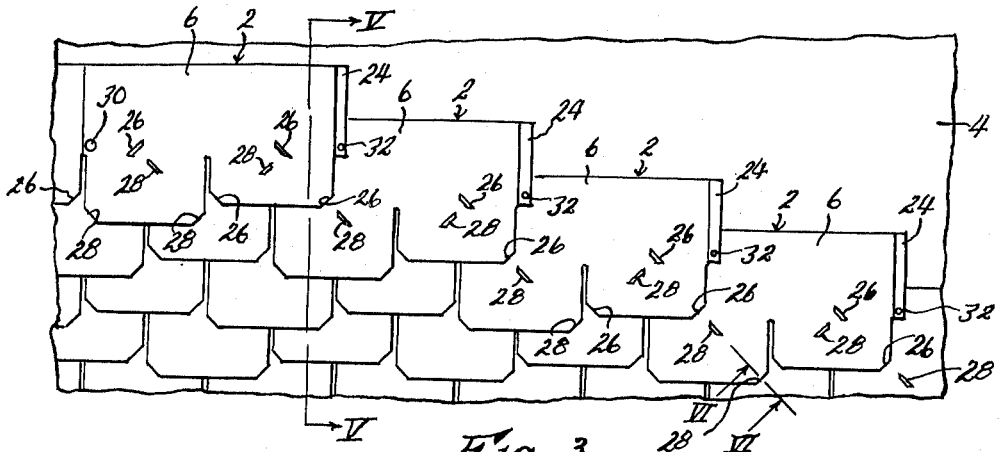
Figure 4:
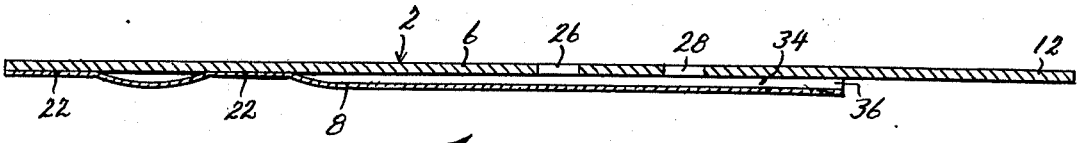
Figure 5:
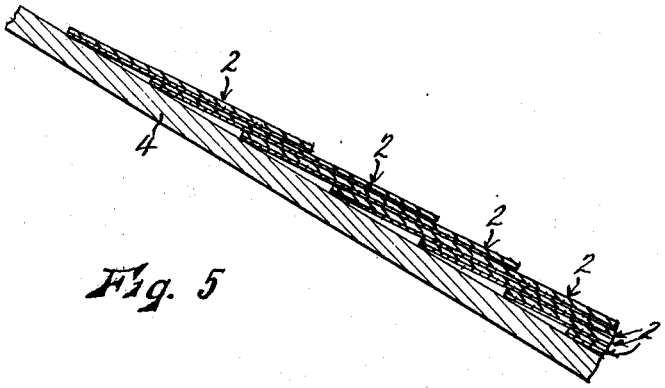
Figure 6:
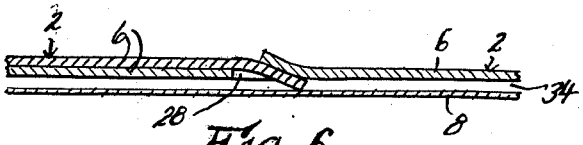

With these objects in view, as well as other objects which will appear in the course of the specification, reference will be had to the accompanying drawing, wherein:

FIG. 1 is a top plan view of a two-tab roofing shingle embodying the present invention, FIG. 2 is an inverted plan view of the shingle shown in FIG. 1, FIG. 3 is a fragmentary top plan view of a roof to a portion of which shingles embodying the present invention, shown to a reduced scale, have been applied, FIG. 4 is an enlarged sectional view taken on line IV—IV of FIG. 1, with the free portion of the backing sheet slightly separated from the shingle body, for clarity, FIG. 5 is an enlarged, fragmentary sectional view taken on line V—V of FIG. 3, FIG. 6 is an enlarged, fragmentary sectional view taken on line VI—VI of FIG. 3, FIG. 7 is a top plan view of a single-tab shingle embodying the present invention, and FIG. 8 is an inverted plan view of the shingle shown in FIG. 7.

Like reference numerals apply to similar parts throughout the several views, and the numeral 2 applies generally to a two-tab shingle embodying the present invention, and shown in FIGS. 1–4. Said shingle is generally rectangular, and both for convenience and in view of its usual position when applied to the sheathing boards 4 of a sloping roof as shown in FIGS. 3 and 5, its vertical dimension as viewed in FIG. 1 will be referred to as its height, and its horizontal dimension as viewed in FIG. 1 will be referred to as its width. Said shingle includes a main layer or body 6 consisting of a sheet of ordinary composition roofing material, consisting generally of an asphaltic compound the outer surface of which is covered by a layer of finely divided chat or the like, not shown, and which is quite flexible transversely of its plane. Bonded to the rearward face of body 6 is a backing sheet 8 constituting a sheet of relatively thin, waterproof material such as "tarpaper" or roofing felt as it is commonly named.

The shingles 2 are applied to the sheathing boards 4 of a roof as illustrated in FIG. 3, the shingles being applied in a first horizontal course at the lower edge of a roof, in side-by-side relation, and then in successively higher courses offset upwardly in steps from said first course. Each higher course overlaps the outer surface of the next lower course, as shown.

The lower edge portion of each shingle 2 is divided centrally by a vertical slit 10 into one relatively long tab 12 and one relatively short tab 14. Said tabs occupy substantially the full width of the shingle, excepting only the width of slit 10, and narrow cut-outs 16 at the distal sides of the tabs, each of said cut-outs being one-half the width of slit 10, and extending to the same height as slit 10. The upper ends of slit 10 and cut-outs 16 are disposed at the same vertical point in the height of the shingle. As best shown in FIGS. 1 and 2, backing sheet 8 covers all of the back surface of body sheet 6 except the lower portions of tabs 12 and 14, extending lower than the upper ends of slit 10 and cut-outs 16. Said backing sheet is adhered to the body sheet, not over its entire area, but along the vertical edges of the shingle, as indicated by stippled areas 18 in FIG. 2, along a vertical line bridging slit 10, as indicated by stippled area 20, and along one or more lines at or adjacent the top edge of the shingle, as indicated by stippled areas 22, but not along the lower edge of the backing sheet. Of course, it will be understood that the stippled areas of FIG. 2 are merely indicative of an adhesive actually disposed between the body and backing sheets, and that the adhesive would not actually appear on the underside of the shingle as might appear in FIG. 2. At one vertical side of the shingle, preferably the right side in deference to the fact that most roofers lay a course of shingles from left to right, backing sheet 8 is extended beyond body sheet 6 to form a narrow tab 24, extending vertically from the top edge of the shingle to the top end of cut-out 16 at that side of the shingle.

At respectively opposite sides of the vertical midline of each shingle tab, a pair of outwardly and downwardly inclined diagonal slots 26 and 28 are cut through body sheet 6, but not through backing sheet 8, slots 26 being relatively higher in the shingle than slots 28. Slots 26 slope downwardly and outwardly toward the sides of the shingle, and are spaced horizontally farther apart than slots 28, and slots 28 slope downwardly and inwardly toward slit 10. The horizontal spacing between slots 26 and 28 of each pair is equal to the width of slit 10, and the vertical spacing between the lower ends of each pair of slots is equal to the difference between the vertical lengths of tabs 12 and 14. The lower ends of slots 26 are spaced from the upper edge of the shingle by a distance equal to the distance the side of the shingle carrying shorter tab 14 overlaps the next lower course of shingles, and the lower ends of slots 28 are spaced from the upper edge of the shingle by a distance equal to the distance the side of the shingle carrying the longer tab 12 overlaps the next lower course of shingles. The horizontal distance between the upper ends of slots 28 is thus equal to the horizontal width of tab 12, and the upper ends of slots 26 will be spaced horizontally from the upper ends of the next adjacent slots 26 in adjoining shingles in the same horizontal course of shingles by distances equal to the horizontal width of tabs 14. Tabs 12 and 14 are all of equal width.

As the shingles are applied in successively higher courses, as indicated in FIG. 3, the shingles of each higher course are offset horizontally to the right, relative to the shingles of the previously applied next lower course, by a distance equal to one-fourth of the width of a shingle. This places the lower corners of longer tab 12 of each shingle being applied in registry with slots 28 of a shingle in the next lower course, and the lower corners of shorter tab 14 in registry with the right slot 26 in the lower shingle, and with the left slot 26 of the next shingle to the right in the next lower course. The corners of both tabs are inserted into the slots with which they are then registered, the shingle finally positioned, and secured in position by a nail 30 driven therethrough adjacent its left edge (see upper left portion of FIG. 3), in the portion thereof overlying tab 24 of the next shingle. The nail thus pierces the shingle then being applied, the tab 24 of the next left shingle in the same course, and a shingle in the next lower course. The positions for the driving of nails through the tabs 24 of the rightmost shingle in each course, when the next right shingle is applied in each course, are indicated at 32, although of course no nails have as yet been driven at these points. This is a true "one nail per shingle" application, providing both for greater speed and convenience of work, and also an economy in the number of nails used. That is, while each shingle is eventually pierced and secured by three nails, the total number of nails used will still equal the total number of shingles.

The insertion of the tab corners in slots 26 and 28 securely fastens the lower edges of said tabs, which would otherwise be free and liable to be curled or peeled upwardly by wind, to the next lower course of shingles, thereby effectively preventing this type of wind damage. The shingles, although they may initially assume a "wavy" or distorted appearance due to flexure of the tab corners for insertion into the slots, will quickly level to a neat, smooth appearance by their own weight, since the asphaltic compound of which they are formed is both heavy and quite flexible. The position of a tab corner after insertion into a slot is illustrated in FIG. 6.

Slots 26 and 28 of course are "holes" in the shingles, and some rain or other moisture will flow therethrough to the underside of the shingle, despite the fact that said slots are nominally "filled" by the shingle tab corners inserted therethrough. However, any such moisture enters the "pocket" 34 between unadhered portions of the body and backing sheets of the shingle, as best shown in FIGS. 4 and 6. Since said pocket is sealed along all of its edges except its lower edge, said moisture eventually works its way out of the open lower mouth 36 of said pocket, and is deposited harmlessly on the upper or weather surface of the next lower shingle.

It would of course be possible to cut apertures in the shingles which would engage other portions of the lower edges of the tabs than their extreme corners. For example, a slot of inverted U-form could be used, and the shingle portion within the U could be lifted up to receive any part of the length of the lower edge of the next higher shingle thereunder. However, securing the tab corners is preferable, since it is the corners which are most flexible and most easily peeled upwardly by wind. However, since the tabs of a shingle, or adjacent tabs of adjoining shingles in the same course, are only narrowly spaced apart in a horizontal direction, seldom more than one-half inch, the placement of the slots 26 and 28 of each tab to receive the adjacent corners of adjoining tabs places said slots horizontally at the same narrow spacing. If the tabs were of equal length, this would result in a very narrow strip of the body sheet between the slots, which could easily break or tear, since composition shingles do not have a high tearing strength. By making the two tabs of the shingle of different lengths, as shown, the slots 26 and 28 of each tab are spaced apart not only horizontally, which as noted above must be a narrow spacing, but also vertically, by a distance equal to the difference between the lengths of the tabs. In this manner, a relatively broad band of shingle body between the slots is preserved, and adequate strength is maintained. The alternately different tab lengths also provides a pleasingly irregular or "thatched" appearance for the roof. Slots 26 and 28 need not be of the specific shape shown. The only basic requirements are that each be capable of receiving a portion of the lower edge of the next higher tab therein, and that a portion of the shingle in which the slot is formed be disposed above the tab so inserted.

Backing sheet 8 of the shingle not only provides pockets 34 for trapping and disposing of any moisture passing through slots 26 and 28, as already discussed, but also provides a "dry-ply" which, by reason of horizontally extending tabs 24 which underlie the next adjacent shingle, is substantially continuous over the entire roof, and hence eliminates any necessity of applying a layer of roofing felt or the like over the entire roof area before applying the shingles.

FIGS. 7 and 8 show a single-tab shingle 38 which is identical to the right half of the shingle shown in FIG. 1, and could be produced by severing the FIG. 1 shingle vertically in alignment with slit 10. Corresponding parts are indicated by corresponding primed numerals. The tab 14' of this shingle corresponds to shorter tab 14 in FIG. 1. Shingle 38 would be used in alternating sequence with another single-tab shingle identical in all respects to shingle 38, except that its tab would correspond in length to longer tab 12 of FIG. 1, and that the placement of slots 26' and 28' therein would correspond to slots 26 and 28 of tab 12 in FIG. 1. The two single-tab shingles would be applied alternately in each horizontal course of shingles, and the resulting roof would be indistinguishable from that produced by the two-tab shingle of FIG. 1. However, the one-tab variation has an advantage in that its use requires the placement of the corners of only one tab at a time in the slots 26' or 28' formed to receive them, while use of the two-tab shingle requires the virtually simultaneous insertion of all four of its tab corners into four slots, which can be a rather tedious operation requiring considerable dexterity. The single-tab model also requires more nails, more shingle handling, and a conscious alternation of tab lengths, but the latter difficulty can be largely overcome by bundling the single-tab shingles of the two different tab lengths in alternating order.

While I have shown and described certain specific embodiments of my invention, it will be readily apparent that many minor changes of structure and operation could be made without departing from the spirit of the invention.

What I claim as new and desire to protect by Letters Patent is:

1. A roofing shingle comprising a generally rectangular body sheet of flexible roofing material having at least one tab at its lower edge, like shingles being adapted to be applied to a roof in side-by-side abutting relation in a horizontal course transverse to the slope of said roof, and in successively higher like courses each overlapping the outer surface of the next lower course, the tabs of each course being horizontally staggered with respect to the tabs of adjoining courses, each tab of each shingle having a pair of apertures formed therethrough in horizontally spaced apart relation and in spaced apart relation above the lower edge of said tab, each of said apertures being adapted to receive therein a lower edge portion of one of the two tabs of the shingles of the next higher course of shingles overlapping said tab, each of said apertures being so formed that when the lower edge of a next higher tab is inserted therein, a portion of the lower tab adjacent said aperture is disposed over the portion of said higher tab inserted into said aperture, and a backing sheet of flexible waterproof material applied to the back surface of said body sheet, said backing sheet extending from the upper edge of said body sheet downwardly at least to an elevation of said body sheet below said apertures, and to a portion of said body sheet which overlaps the next lower course of shingles, said cover sheet being effectively adhered to said body sheet except in the area of said apertures and in a continuous path from said apertures to the lower edge of said backing sheet, whereby any moisture passing downwardly through said apertures is conveyed between said body and backing sheets to the lower edge of said backing sheet, where it is deposited on the outer surface of the next lower course of shingles.

2. A roofing shingle as recited in claim 1 wherein said backing sheet is extended horizontally from said body sheet at one side thereof to underlie the next successive shingle in the same horizontal course.

3. A roofing shingle as recited in claim 1 wherein said apertures are positioned to receive the extreme opposite ends of the tabs of the next higher course of shingles, and wherein the tabs of each horizontal course of shingles are alternately of two different lengths, whereby the apertures of each tab are spaced apart vertically of said body sheet by a distance equal to the difference between said two different tab lengths, thereby providing a greater width between apertures, for greater strength.

4. A roofing shingle as recited in claim 1 wherein the lower ends of said shingle tabs are substantially square-cornered, and wherein each of said apertures constitute a diagonal slot positioned to intersect the tab corner to be inserted therethrough, in spaced relation from said corner, and wherein the tabs of each horizontal course of shingles are alternately of two different lengths; whereby the two diagonal slot apertures of each tab are spaced apart vertically of said body sheet by a distance equal to the difference between said two different tab lengths, thereby providing a greater width of said body sheet between said apertures for greater strength.

5. A roofing shingle as recited in claim 1 wherein the lower edge portion of said body sheet is vertically divided to form two horizontally spaced apart tabs of equal width and unequal lengths, and having square lower corners, and wherein said apertures of each tab constitute a pair of diagonal slots disposed respectively at opposite sides of the vertical midline of said tab and sloping downwardly and outwardly from said midline, each being positioned to receive therethrough a corner of a tab of a shingle of the next higher course of shingles, the two contiguous slots of the two tabs being at the same lower elevation of said shingle with their upper ends horizontally spaced apart by a distance equal to the width of a tab, whereby to receive the respective corners of a longer tab of the next higher course of shingles, and the two distal slots of the two tabs being disposed at an elevation of said shingle higher than that of said contiguous slots by a distance equal to the difference of length of the two tabs, with their upper ends being horizontally spaced apart by a distance equal to the width of a single tab, plus twice the horizontal width of the space between said tabs.

* * * * *